US006763815B2

(12) United States Patent
Gerhardt et al.

(10) Patent No.: US 6,763,815 B2
(45) Date of Patent: Jul. 20, 2004

(54) DEVICE AND METHOD FOR REGULATING THE ENERGY SUPPLY FOR IGNITION IN AN INTERNAL COMBUSTION ENGINE

(75) Inventors: Juergen Gerhardt, Oberriexingen (DE); Martin Haussmann, Sachsenheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/239,044

(22) PCT Filed: Feb. 23, 2001

(86) PCT No.: PCT/DE01/00689

§ 371 (c)(1),
(2), (4) Date: Dec. 27, 2002

(87) PCT Pub. No.: WO01/69079

PCT Pub. Date: Sep. 20, 2001

(65) Prior Publication Data

US 2003/0089353 A1 May 15, 2003

(30) Foreign Application Priority Data

Mar. 16, 2000 (DE) ..... 100 12 956

(51) Int. Cl.[7] ..... F02P 3/045
(52) U.S. Cl. ..... 123/609; 123/644
(58) Field of Search ..... 123/609, 644, 123/406.53, 406.55; 361/247, 253, 263, 103

(56) References Cited

U.S. PATENT DOCUMENTS

| | | | | |
|---|---|---|---|---|
| 3,882,840 A | | 5/1975 | Adamian et al. | 123/644 |
| 5,283,527 A | | 2/1994 | DeBiasi | 123/643 |
| 6,431,145 B1 | * | 8/2002 | Denz et al. | 123/406.24 |
| 6,571,783 B1 | * | 6/2003 | Denz et al. | 123/609 |
| 6,597,556 B1 | * | 7/2003 | Michel et al. | 361/103 |
| 2003/0106521 A1 | * | 6/2003 | Konrad et al. | 123/295 |

FOREIGN PATENT DOCUMENTS

| | | |
|---|---|---|
| DE | 199 56 381 | 4/2001 |
| EP | 0 373 694 | 6/1990 |
| EP | 0 578 958 | 1/1994 |
| EP | 0 757 177 | 2/1997 |
| EP | 0 882 886 | 12/1998 |

OTHER PUBLICATIONS

"Technical Information, Combined Ignition and Gasoline Injection System with Lambda Regulation Engine Management System", Robert Bosch GmbH, 1983, p. 11.

* cited by examiner

*Primary Examiner*—Hai Huynh
(74) *Attorney, Agent, or Firm*—Kenyon & Kenyon

(57) ABSTRACT

A device for regulating the energy supply for the ignition of an internal combustion engine including an ignition coil and a central control unit, the ignition coil including a primary winding and an ignition power module connected to the primary winding. The central control unit ascertains a time difference between the beginning of current flow through the primary winding and the reaching of a first threshold value of the primary current, and in the light of the time difference, the central control unit determines an additional power loss of the ignition power module and/or active energy reduction, caused by interturn short circuits in the primary winding. When the additional power loss of the ignition power module exceeds a power loss threshold value, the ignition power module is switched off.

28 Claims, 2 Drawing Sheets

DEVICE AND METHOD FOR REGULATING THE ENERGY SUPPLY FOR IGNITION IN AN INTERNAL COMBUSTION ENGINE

FIELD OF THE INVENTION

The present invention relates to a device and a method for regulating the energy supply for ignition in an internal combustion engine.

BACKGROUND INFORMATION

A device and a method for regulating the energy supply for ignition in an internal combustion engine is described in "Technische Unterrichtung, Kombiniertes Zünd- und Benzineinspritzsystem mit Lambda-Regelung-Motronik Technical Information, Combined Ignition and Gasoline Injection System With Lambda Regulation Engine Management System", Robert Bosch GmbH, 1983. In that document, on page 11, a dwell angle control is described, the energy, continuously increased over the dwell time and reached at the point of ignition, stored in the magnetic field of the ignition coil, which, as a first approximation is proportional to the square of the attained primary current value, is changed as a function of a characteristics map. In this context, the characteristics map is a function of the battery voltage and the engine speed.

Furthermore, in German Patent Application No. 199 563 81.0 a device and a method for ignition of an internal combustion engine is described in which the turn-on time, i.e., the time difference between the energizing edge in the signal line, which corresponds to the beginning of current flow through the primary winding, and the point in time at which the primary current reaches a first threshold value, is ascertained. The turn-on time is determined in the light of the signals in the signal line and signals in one or more diagnostic lines, which connect a central control unit to the ignition power module.

SUMMARY OF THE INVENTION

The device and method, respectively, according to the present invention may provide the advantage that it is ensured that there will be no overheating of the ignition power module, i.e., that a maximum allowable power loss, which drops in ignition power module 13, is not exceeded, and, on the other hand, a sufficient energy supply is present for the ignition. In this connection, the non-exceeding of the maximum power loss has priority. Thus, direct reactions may be formed to changes in the primary winding coming about during the running time of the engine, such as newly occurring short circuits, i.e., coil and wiring harness defects. In this context, the regulation may occur in both directions, that is, in the direction of an increase or a decrease in the energy supply.

It may be advantageous that the ignition power module temperature may be ascertained, in the light of the power loss dropping off in the ignition power module, with the aid of the temperature of the surroundings of the ignition power module, in order to avoid damage, the ignition power module having to be switched off when the temperature of the ignition power module is too high. Here, it may be advantageous to ascertain the temperature of the surroundings of the ignition power module using a temperature sensor, since in that manner a very accurate reading of the surrounding temperature is possible. It may also be advantageous to read out the surrounding temperature of the ignition power module, with the aid of a predefined value or as a function of certain operating states, from a characteristics map from a memory unit of the central control unit, since then no temperature sensor will be needed. Furthermore, if a temperature sensor is present, it may be advantageous to use the characteristics map's functional dependency of the surrounding temperature of the ignition power module to check the functional capability of the temperature sensor, and, in the failure case, to replace the surrounding temperature ascertainment, using the sensor, by the characteristics map. It may also be advantageous to calculate the used power loss due to line resistances and winding resistances which are temperature-dependent, in the light of the ascertained temperature of the primary winding, and to give consideration to this in making available the energy supply.

Example embodiments of the present invention are illustrated in the drawings and are explained in greater detail in the following description.

DETAILED DESCRIPTION

Figure 1:
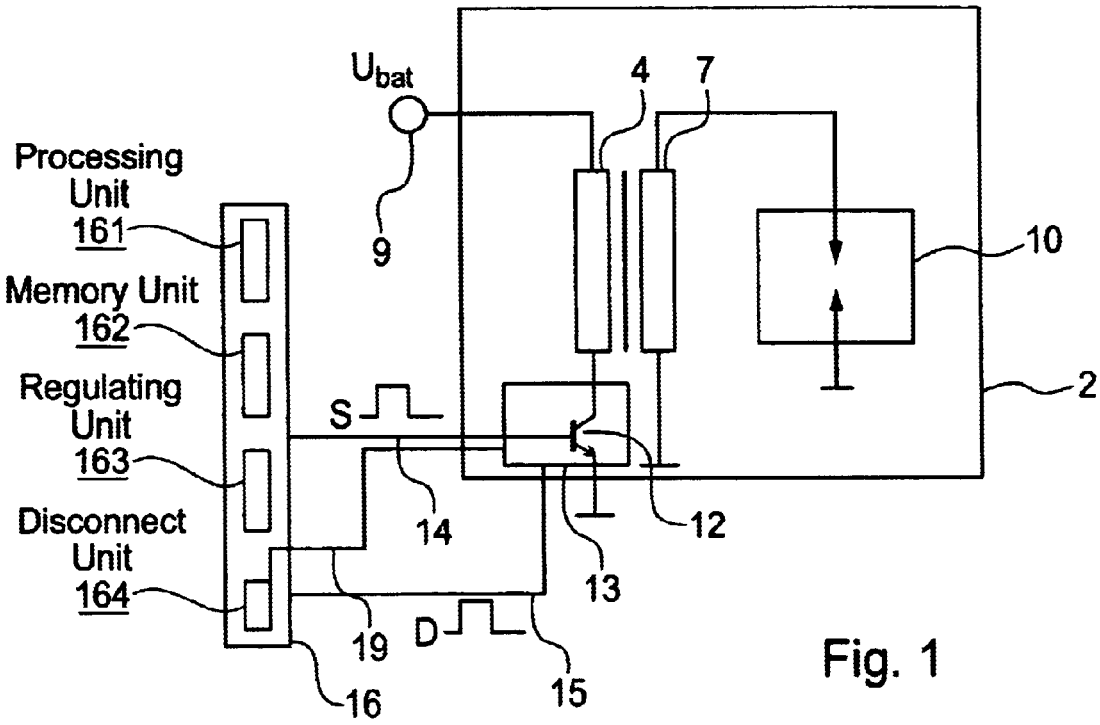
FIG. 1 illustrates a device according to the present invention for regulating the energy supply in the primary winding of an internal combustion engine ignition coil.

FIG. 1 illustrates schematically a device for regulating the energy supply in the primary winding of an internal combustion engine ignition coil. In the device, ignition circuit 2 includes an ignition coil, for each cylinder of the internal combustion engine, including a primary winding 4 and a secondary winding 7, one side of secondary winding 7 is grounded, and the other side of secondary winding 7 is connected to one electrode of spark plug 10. The second electrode of spark plug 10 is connected to ground. One side of primary winding 4 is connected to battery voltage ($U_{bat}$) 9. The other side of primary winding 4 is connected to a controllable switch 12, controllable switch 12 is a part of an ignition power module 13. In one example embodiment, controllable switch 12 is configured as a power transistor, primary winding 4 then is connected to the collector of the power transistor. The other output of the controllable switch is connected to ground, and it is the emitter of the power transistor that is connected to ground when a power transmitter is used as controllable switch 12. The control input of controllable switch 12, e.g., the base of the power transistor, goes via a signal line 14 to a central control unit 16. Central control unit 16 includes a processing unit 161, a memory unit 162, a regulating unit 163 and a disconnect unit 164, disconnect unit 164 is connected to ignition power module 13 via a connecting line 19.

Ignition power module 13 is also connected to central control unit 16 via a diagnostic line 15.

If an ignition is to occur, a signal edge is sent by central control unit 16 via signal line 14 to ignition power module 13, i.e., to the controllable input of controllable switch 12, and in the example embodiment of controllable switch 12 as a power transistor, e.g., to the base of the power transistor. This edge acts so as to connect through controllable switch 12 and a current flow through primary winding 4. The current flows from the connection to battery voltage 9 via primary winding 4 and controllable switch 12 to ground. At the point of ignition, a second edge is sent to controllable switch 12 by central control unit 16 via signal line 14, the controllable switch now blocking. Thereby current flow in primary winding 4 is interrupted, and a voltage is induced in secondary winding 7, which leads to igniting an ignition spark in spark plug 10.

As is described in German Patent Application No. 199 56 381.0, ignition power module 13 includes signal-forming elements, e.g., edge-building elements, as well comparators and/or sensors which are able to compare the variables of ignition circuits, e.g., primary current and primary voltage to threshold values. Ignition power module 13 includes a comparator which compares the primary current, i.e., the current through primary winding 4 of the ignition coil, to a first threshold value I1, and, at the point in time at which the primary current exceeds first threshold value I1, sends an edge by the edge-forming element also present in ignition power module 13 to diagnostic line 15, which then reaches central control unit 16 via diagnostic line 15. Furthermore, central control unit 16 includes a time-processing unit which compares the signals on the signal line and the signals on the diagnostic line to a time counting unit and may thus ascertain time intervals.

Figure 4:
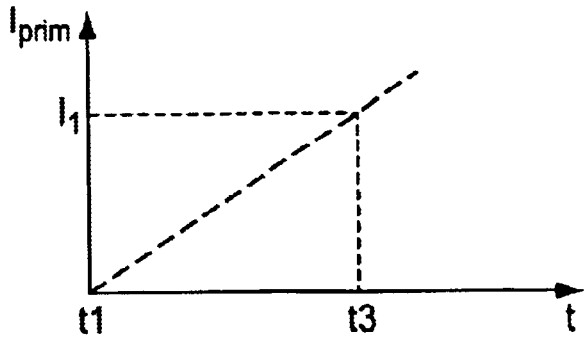
FIG. 4 illustrates a graph in which the primary current is plotted as a function of time.

The characteristic of the primary current is here explained once more in the light of the diagram illustrated in FIG. 4, in which the primary current is plotted as a function of time. At point T1, controllable switch 12 is closed by an edge on the signal line, and thereby is switched on a current flow through primary winding 4 of the ignition coil. This current increases with time as illustrated, and at point T3 it exceeds a first threshold value I1. The comparator present in ignition power module 13 compares the primary current to first threshold value I1. As was explained before, only when this first threshold value I1 is exceeded, a signal is sent by the signal-forming element contained in ignition power module 13 to central control unit 16 via diagnostic line 15, and an edge-forming element of ignition power module 13 sends an edge to central control unit 16 via diagnostic line 15.

Central control unit 16 then makes a comparison, using a time processing unit, of the signals on signal line 14 and on diagnostic line 15 using a time counting unit, and the time period is ascertained between the edge on signal line 14, which acts to switch through controllable switch 12, and the edge, which reaches the central control unit on diagnostic line 15 due to the exceeding of a first threshold value of the primary current. This time is denoted as the turn-on time below, and corresponds to time t3–t1 in FIG. 4.

In the case of an internal combustion engine including several cylinders, an ignition circuit 2 is provided for each cylinder, each ignition circuit is connected to the central control unit via a signal line. For each ignition power module 13 of each cylinder there exists a diagnostic line 15 which starts out from each respective ignition power module 13. The diagnostic line 15 starting from ignition power module 13 of each cylinder may be connected either direct1y to central control unit 16 or, in an example embodiment, conducted via a linkage module in which the diagnostic lines of several cylinders are connected to form one diagnostic line, the linkage module, in turn, is connected to central control unit 16 via a linkage diagnostic line. In the linkage module, the incoming diagnostic signals from each cylinder are linked in the correct temporal sequence. The linkage is described in detail in German Patent Application No. 199 56 381.0.

Figure 2:
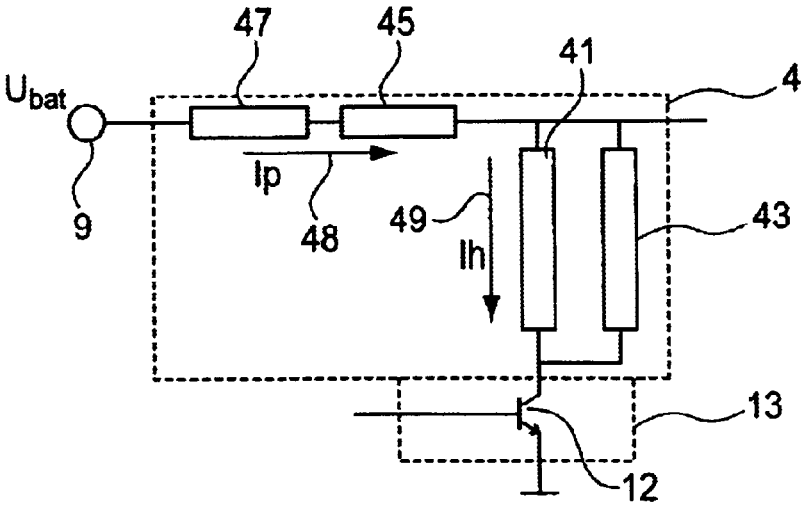
FIG. 2 illustrates a schematic equivalent circuit diagram for the primary winding of an ignition coil, together with a connection to the battery voltage and a controllable switch.

FIG. 2 illustrates an equivalent circuit diagram of primary winding 4 of the ignition coil. Also represented are terminals 9 for battery voltage $U_{bat}$ and controllable switch 12, as well as the linkage between controllable switch 12 and primary winding 4. The resistances and inductances present in primary winding 4 may be represented by a leakage inductance 47, a line and winding resistance 45 and an active inductance 41 connected in series between the battery voltage and controllable switch 12. In parallel with the active inductance, a short-circuit resistance 43 is also present, which represents the fluctuating ohmic resistances over the operating time of the primary winding. Leakage inductance 47 as well as line and winding resistance 45 are known from the data of the primary coil. Primary current Ip 48 flows through leakage inductance 47 and through line and winding resistance 45. This primary current is divided by active inductance 41, and short-circuit resistance 43 connected in parallel to it into an active current Ih which flows through active inductance 41, and a short circuit current which flows through short circuit resistance 43. The sum of the two currents generates a power loss in ignition power module 13. The so-called active energy, i.e., the energy that is actually available to spark plug 10 for the ignition spark, is also generated in active inductance 41. This is determined by the current flowing through the inductance at the point in time at which the controllable switch blocks. Thereby, as already described above, the current flowing through the inductance rises continuously over the dwell time.

Under normal conditions, i.e., without interturn short circuits present in the primary coil, short-circuit resistance 43 is a very low, negligible current. However, if interturn short circuits are present in the failure case, the value of short-circuit resistance 43 drops off, and a large current flows through short circuit resistance 43, above all, shortly after switching through controllable switch 12 at the beginning of the dwell time. Now, if the total current, i.e., the sum of the currents flowing through active inductance 41 and through short circuit resistance 43, is viewed in the failure case, then this total current is clearly increased, above all, shortly after switching through controllable switch 12 in comparison to the normal condition. This leads to an increased power input into ignition power module 13 in comparison to the normal condition, and thus to a temperature increase of ignition power module 13. In the worst case, exceeding a maximum temperature may lead to the destruction of ignition power module 13. Furthermore, the energy lost in the short circuit resistance and in ignition power module 13, at constant dwell time, leads, as compared to the normal condition, to a reduction in the active energy, i.e., the energy available for ignition is reduced, which may lead to ignition misfires.

In the light of the turn-on time which was ascertained, as explained above, in central control unit 16 and is available there, it is now possible to ascertain the power loss occurring in ignition power module 13 due to short circuits in the primary coil windings. The energy reduction of the active energy may be determined in the same manner. This may be done in that a short circuit resistance value $R_{short}$ is assigned to the turn-on time ascertained via a characteristic map, which, also is a function of battery voltage $U_{bat}$. This characteristics map is contained in memory unit 162. In this context, the value measured at that point is used as the battery voltage $U_{bat}$. Then, using short circuit resistance value $R_{short}$, and via a battery voltage-dependent characteristics map, the power loss additionally dropping off in ignition power module 13 and the active energy reduction generated in active inductance 41 are ascertained. These characteristics maps are also contained in memory unit 162.

After the determination of the power loss additionally dropping off in ignition power model 13, and of the active energy reduction, a test is first made to see whether the additionally dropping power loss in ignition power module 13 exceeds a power loss threshold value. If this is the case, ignition power module 13 of the respective cylinder is switched off, because then there exists the danger that ignition power module 13 will be destroyed. Alternatively, a reduction of the dwell time may also be performed, since this reduces the power loss in ignition power module 13. In this connection, the time between the beginning of current flow through the primary winding, i.e., the switching through of controllable switch 12 and the switching off of the current flow through the primary winding, i.e., the blocking of controllable switch 12, is called dwell time $t_{dwell}$. According to that, for the reduction of the dwell time, the temporal distance between the edge which switches through controllable switch 12 and the edge which blocks again controllable switch 12 is reduced.

Switching off ignition power module 13 or reducing the dwell time may be provided in a further example embodiment with a time constant, which means that, after determining for the first time that the power loss threshold value has been exceeded, and in the case where this condition continues over several cycles, the resulting action (switching off or reduction of the dwell time) is only performed after a certain time, since only a longer duration of this condition leads to the destruction of ignition power module 13. In this situation, what may be advantageous is the avoidance of switching off the ignition power module or the reduction of the dwell time that are based on faulty power loss values or active energy values.

If the power loss threshold value is not exceeded, the dwell time is prolonged corresponding to the active energy reduction, so that, based on a prolonged dwell time, the current, flowing through active inductance 41 at the point in time of the blocking of controllable switch 12, is increased. Thus, the active energy is increased, i.e., a greater energy is available for ignition, and active energy reduction is minimized. Regulating unit 163 assumes the regulation of the dwell time. Since the additional power loss appearing in ignition power module 13 is also increased on account of a prolonged dwell time, for each dwell time increase it has to be checked whether the power loss threshold value has been exceeded.

In one further example embodiment, if a smaller reduction of the active energy is ascertained than at an earlier point in time, a reduction in the dwell time is provided. This reduction in the dwell time is performed by regulating unit 163. However, the active energy should not fall below an active energy threshold value, since, when the energy available for ignition is too low, ignition misfires may occur. This causes a deterioration in the quiet running of the internal combustion engine.

In additional example embodiments, the voltage made available to the primary winding by regulating unit 163 is regulated, instead of regulating dwell time $t_{dwell}$.

In this context, in one example embodiment, the dwell time or the voltage made available to primary winding by regulating unit 163 is changed in small steps in the respective direction desired.

A power loss temperature may also be assigned by central control unit 16 to an additional power loss appearing in ignition power module 13, which is generated by ohmic heat is set free in ignition power module 13.

Figure 3:
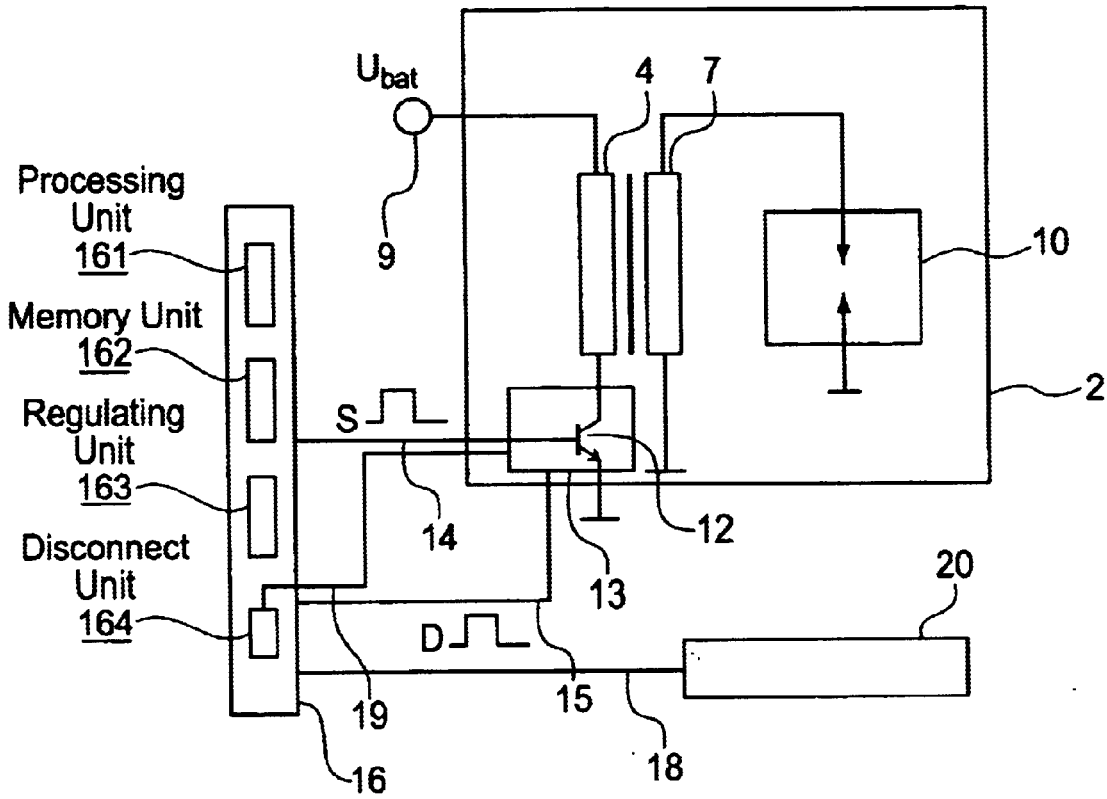
FIG. 3 illustrates another example embodiment of a device according to the present invention for regulating the energy supply in the primary winding of an internal combustion engine ignition coil.

This power loss temperature may be estimated, and is contained in memory unit 162 as a characteristic curve as a function of short circuit resistance value $R_{short}$ or as a function of the additional power loss in the ignition power module. Furthermore, the surroundings of ignition circuit 2 have a certain surroundings temperature which depends on factors such as weather conditions, how long the internal combustion engine has been operated in the current operating cycle, as well as other thermally coupled ohmic resistances present in the vicinity of ignition circuit 2 and possibly any cooling that may be present. The temperature of the surroundings may be estimated in gross approximation by a fixed predefined value or may be available in a characteristics map in memory unit 162 of central control unit 16, as a function of certain operating conditions which are characterized, for instance, by the operating duration after starting the internal combustion engine or by the temperature of the cooling water at the cylinder head. Then again, in an example embodiment, the temperature of the surroundings may also be measured by using a temperature sensor 20 in the vicinity of ignition circuit 2, as illustrated in FIG. 3. The temperature sensor is connected to central control unit 16 via sensor line 18.

Except for temperature sensor 20 and sensor line 18, the device for regulating the energy supply in the primary winding of an internal combustion engine ignition coil, illustrated in FIG. 3, corresponds to the device illustrated in FIG. 1. That is why the remaining components of the device illustrated in FIG. 3 are not described in detail again.

In one example embodiment, the reading of temperature sensor 20 is checked by central control unit 16 to see whether the temperature sensor gives plausible values for the temperature of the surroundings. This may be done by seeing that the temperature ascertained by temperature sensor 20 lies in a plausible temperature range. If the values ascertained for the temperature of the surroundings by the temperature sensor do not lie in a plausible temperature range, it is assumed that temperature sensor 20 or sensor line 18 is defective. The values of the temperature of the surroundings used to determine the temperature of the ignition power module are then read out from the characteristics map, or a fixed predefined value is applied. In this context, the characteristics map, as a function of certain operating conditions, which are characterized, for example, by the operating duration after starting the internal combustion engine or by the temperature of the cooling water at the cylinder head, is present in memory unit 162 of central control unit 16.

The temperature at ignition power module 13 may be determined in the light of the power loss temperature and the temperature of the surroundings. It comes about as the sum of the power loss temperature and the temperature of the surroundings. It is ascertained by processing unit 161 of the central control unit. Central control unit 16 now conducts a comparison of the temperature of ignition power module 13 to a temperature threshold value. If the temperature of the primary winding is greater than the temperature threshold value, the ignition circuit is overheated, and the ignition power module 13 should be switched off. This is done by disconnect unit 164 which is connected to ignition power module 13 via a connecting line 19, central control unit 16 causing the switching off of ignition power module 13 by disconnect unit 164.

Here too, in an example embodiment, analogously to switching off ignition power module 13 due to exceeding the power loss threshold value, a temperature time constant may be provided which shifts the switching off of ignition power module 13 by a certain further fixed time after the first determination that the temperature threshold value has been exceeded.

When there is an increase in temperature of ignition power module 13, there is further an increase of line and winding resistances 45 of the primary coil. This has the result that more power loss is dissipated over line and winding resistances 45 than in the cold state. For this, it is necessary to prolong the dwell time in proportion to the temperature of primary winding 4. This may be done by having a characteristic curve present in memory unit 162 which makes available a dwell time prolonging value $t_{prolong}$, dependent on the temperature of the primary winding. This dwell time prolonging value $t_{prolong}$ is added to the dwell time $t_{dwell}$, which is derived from the above-described regulation of the dwell time, with respect to the additional power loss of the ignition power module and with respect to the active energy.

In a further example embodiment, at constant dwell time, a systematic, strictly continuous prolonging of the turn-on time may be observed, and in the light of this, a thermally conditioned increase of the ohmic resistance of the primary winding of the coil may be estimated.

In one further example embodiment, based on increased temperature, increased line and winding resistances may be compensated for by increasing the voltage present at the primary winding.

In yet another example embodiment, the above-described devices or methods may also be transferred to an internal combustion engine including several cylinders. In an internal combustion engine including several cylinders, an ignition circuit 2 is assigned to each cylinder and is connected to central control unit 16, each via a signal line 14. A diagnostic line 15 exits from ignition power module 13 of each cylinder, via which ignition power module 13 is connected to the central control unit, and via which transmission of the diagnostic signals may occur. A linkage of several diagnostic lines to a linkage diagnostic line has already been described above. For an internal combustion engine including several cylinders, the additional power loss of ignition power module 13 or the active energy reduction of each cylinder is undertaken individually for each cylinder, and thus the dwell time regulation is also undertaken individually for each cylinder. Thereby the temperature of ignition power module 13 is also ascertained individually for each cylinder, from which derives a switching off of the respective ignition power module 13 individually for each cylinder when the power loss threshold value or the temperature threshold value is exceeded. The dwell time prolonging value $t_{prolong}$, which is derived from the temperature conditioned increase in the line and winding resistance, is also ascertained individually for each cylinder and added to dwell time $t_{dwell}$, In one further example embodiment, the time processing unit, which takes over the ascertainment of the turn-on time from the signals of signal line 14 or signal lines 14 and the signals of diagnostic line 15 or diagnostic lines 15 or the linkage diagnostic line or the linkage diagnostic lines, may also be positioned separately from central control unit 16.

In a yet further example embodiment, the average power loss in the ignition power module is a function of other operating parameters, e.g., of the rotational speed. Thus the additional power loss of the ignition power module is also a function of other operating parameters (in addition to the battery voltage dependency), e.g., of the rotary speed. This operating parameter dependency is ensured by a characteristics map contained in memory unit 162.

In still another example embodiment, the power loss temperature, which is present in memory unit 162 in a characteristics map, is contained as a function of short-circuit resistance value $R_{short}$ and additional parameters, e.g., a function of the temperature of the surroundings or of the time which has elapsed since starting the internal combustion engine, or of the temperature of the cylinder head cooling water.

What is claimed is:

1. A device for regulating an energy supply for an ignition of an internal combustion engine, the device comprising:

an ignition coil including a primary winding and an ignition power module connected to the primary winding; and a central control unit configured to ascertain a time difference between a beginning of a current flow through the primary winding and a reaching of a first threshold value of a primary current, the central control unit further configured to determine a power loss of the ignition power module as a function of the time difference, the power loss being compared to a power loss threshold value, and the energy supply for the ignition being reduced when the power loss of the ignition power module exceeds the power loss threshold value.

2. The device of claim 1, wherein when the power loss threshold value is exceeded by the power loss of the ignition power module, the ignition power module is switched off by a disconnect unit connected to the ignition power module.

3. The device of claim 1, wherein the central control unit includes a regulating unit, the energy supply for the ignition being regulated by the regulating unit such that a reduction of the energy supply for the ignition is a minimum.

4. The device of claim 3, wherein a controlled variable of the energy supply for the ignition represents a dwell time.

5. The device of claim 4, wherein the ignition power module is switched off by the disconnect unit only after a certain fixed, predefined time after it has been determined that one of the power loss threshold value and the temperature threshold value has been exceeded.

6. The device of claim 3, wherein a controlled variable of the energy supply for the ignition represents a voltage.

7. The device of claim 3, wherein regulation of the energy supply for the ignition is performed in a plurality of steps by the regulating unit, and after each regulating step, an exceeding of the power loss threshold value by the power loss of the ignition power module is checked, using the central control unit.

8. The device of claim 7, wherein after each regulating step, which is connected with a decrease in the energy supply for the ignition, a fall below the power loss is checked using the central control unit.

9. The device of claim 8, wherein the central control unit includes a disconnect unit connected to the ignition power module, such that when a temperature of the ignition power module exceeds a temperature threshold value, the ignition power module is switched off.

10. The device of claim 3, wherein the ignition power module is switched off by the disconnect unit only after a certain fixed, predefined time after it has been determined that one of the power loss fthreshold value and a temperature threshold value has been exceeded.

11. The device of claim 1, wherein a power loss temperature corresponding to the power loss of the ignition power module is ascertained by the central control unit, such that a temperature of the ignition power module is ascertained as a sum of the power loss temperature and a surroundings temperature.

12. The device of claim 11, wherein the central control unit is connected to a temperature sensor, such that the surroundings temperature is ascertained.

13. The device of claim 12, wherein the surroundings temperature is available as one of a fixed, predefined value and a function of operating states in a characteristics map in a memory unit of the central control unit.

14. The device of claim 12, wherein the operating states are characterized by one of a time after a starting of the internal combustion engine and a temperature of a cooling water.

15. A method for regulating an energy supply for an ignition of an internal combustion engine including an ignition coil and a central control unit, the ignition coil including a primary winding which is connected to an ignition power module, the method comprising:

determining a time difference between a beginning of a current flow through the primary winding and a reaching of a first threshold value of a primary current by the central control unit;

determining a power loss of the ignition power module caused by a plurality of interturn short circuits in the primary winding, as a function of the time difference using the central control unit;

comparing the power loss with a power loss threshold value; and reducing the energy supply for the ignition when the power loss of the ignition power module exceeds the power loss threshold value.

16. The method of claim 15, further comprising:

switching off the ignition power module by a disconnect unit connected to the ignition power module, at a time when an exceeding of the power loss threshold value by the power loss of the ignition power module is determined by the central control unit.

17. The method of claim 16, wherein a power loss temperature is ascertained from the power loss of the ignition power module, and from the power loss temperature, a temperature of the ignition power module is ascertained, the temperature of the ignition power module being derived as a sum of the power loss temperature and a surroundings temperature.

18. The method of claim 17, wherein the ignition power module is switched off by a disconnect unit at a time when a temperature of the ignition power module exceeds a certain, predefinable temperature threshold value.

19. The method of claim 18, wherein the ignition power module is switched off by the disconnect unit only after a certain fixed, predefined time after it has been determined that one of the power loss threshold value and the certain, predefinable temperature threshold value has been exceeded.

20. The method of claim 17, wherein, when the temperature sensor is defective, the surroundings temperature is one of derived from a fixed, predefined value and read out from a characteristics map as a function of a plurality of operating states of the internal combustion engine.

21. The method of claim 16, wherein the ignition power module is switched off by the disconnect unit only after a certain fixed, predefined time after it has been determined that one of the power loss threshold value and a certain, predefinable temperature threshold value has been exceeded.

22. The method of claim 15, regulating the energy supply for the ignition by a regulating unit of the central control unit, such that a reduction of the energy supply for the ignition is a minimized.

23. The method of claim 22, wherein a controlled variable of the energy supply for the ignition represents a dwell time.

24. The method of claim 22, wherein a controlled variable of the energy supply for the ignition represents a voltage.

25. The method of claim 22, wherein regulation of the energy supply for the ignition is performed in a plurality of steps by the regulating unit, and after each regulating step, an exceeding of a power loss threshold value by the power loss of the ignition power module is checked using the central control unit.

26. The method of claim 25, wherein after each regulating step in which the energy supply for the ignition is reduced, a fall below the power loss is checked by the central control unit.

27. The method of claim 26, wherein the surroundings temperature is one of derived from one of a fixed, predefined value and a characteristics map as a function of a plurality of operating states of the internal combustion engine and ascertained with aid of a temperature sensor.

28. The method of claim 26, wherein an additional ohmic power loss of line resistances and winding resistances conditioned upon an increased temperature is ascertained by the central control unit in light of a temperature of the ignition power module, and is considered by a prolonging of a dwell time.

* * * * *